US005660689A

United States Patent [19]

Bartelmuss et al.

[11] Patent Number: 5,660,689

[45] Date of Patent: Aug. 26, 1997

[54] APPARATUS FOR ADJUSTING THE HEIGHT AND/OR ANGULAR POSITION OF A STRIP ASSOCIATED WITH THE SCREEN BELT OF A PAPER PRODUCING SYSTEM

[76] Inventors: Klaus Bartelmuss; Heinz Bartelmuss, both of A-8833, Teufenbach 63, Austria

[21] Appl. No.: 353,132

[22] Filed: Dec. 9, 1994

[30] Foreign Application Priority Data

Dec. 21, 1993 [AT] Austria ..... 2580/93

[51] Int. Cl.[6] ..... D21F 1/54

[52] U.S. Cl. ..... 162/352; 162/374

[58] Field of Search ..... 162/352, 374

[56] References Cited

U.S. PATENT DOCUMENTS

| | | | |
|---|---|---|---|
| 3,647,620 | 3/1972 | Truxa | 162/352 |
| 4,865,692 | 9/1989 | Kade et al. | 162/352 |
| 5,129,992 | 7/1992 | Schiel et al. | 162/352 |
| 5,169,500 | 12/1992 | Mejdell | 162/352 |
| 5,262,009 | 11/1993 | Schiel et al. | 162/352 |

*Primary Examiner*—Karen M. Hastings
*Attorney, Agent, or Firm*—Herbert L. Lerner; Laurence A. Greenberg

[57] ABSTRACT

An adjusting apparatus adjusts the height and/or angular position of a strip associated with an screen belt of a paper producing system, which strip extends transversely to a direction of motion of the screen belt. The apparatus is disposed on a machine frame-fixed guide rail. A carriage is mounted displaceably along the fixed guide rail, such that a longitudinal motion of the carriage translates into a vertical adjusting motion of the strip and/or an angular pivoting of the strip relative to the paper pulp screen. A longitudinally nondisplaceable support is attached to the strip and it is supported on the carriage. Guide elements are disposed either in the carriage or the support for adjusting the height and/or angle of the support relative to the fixed guide rail. The support or the carriage have lateral grooves formed therein in which the guide elements are received. The grooves extend at an incline relative to the direction of motion of the carriage by an angle of substantially between 0.5° and 5°.

12 Claims, 4 Drawing Sheets

APPARATUS FOR ADJUSTING THE HEIGHT AND/OR ANGULAR POSITION OF A STRIP ASSOCIATED WITH THE SCREEN BELT OF A PAPER PRODUCING SYSTEM

BACKGROUND OF THE INVENTION

FIELD OF THE INVENTION

The present invention relates to an apparatus for adjusting the height and/or the angular position of a strip associated with the screen belt of a paper producing system, which strip extends transversely to the direction of motion of the screen belt. The strip has a carriage which is displaceable along a guide rail that is fixed to the machine frame, by which means the height and/or the angular position of the strip is adjustable.

In a paper producing system, it is known to dispose a plurality of strips, offset from one another in the direction of motion of the screen belt, on the underside of that screen. The purpose of the strips is on the one hand to scrape off the water that escapes from the pulp and passes through the screen. On the other hand, the strips create an air compression on their front ends (in terms of the direction of motion of the screen belt), which induces turbulence in fibers of the pulp, which in turn changes the structure of the paper or improves the quality of the resultant paper.

It is also known to embody the screen belts in two layers, with the pulp located between the two screens, and to associate such strips with both the underside and the top of the two screens. To achieve the technical effects sought, the heights of the strips must be precisely adjustable. In this respect it may be advantageous if the at least one screen is guided in a slightly undulating path by means of the strips resting on it.

It is also known to dispose the strips in angular positions relative to the screen belt. The first strips, in terms of the direction of motion of the screen, rest flat on the screen. By comparison, the further strips located in the direction of motion of the screen (i.e. downstream strips) are disposed such that they form an acute angle with the screen, on the order of magnitude of up to 5°. Because of the wedge-shaped gaps that form between the screen and the strips, a negative pressure is exerted on the pulp located on the screen or between two screens, and by means of this pressure water in the pulp is removed by suction. For the removal of the water by suction, vacuum boxes are also provided.

The technological requirements and the technological conditions depend on the type of papers that are being produced. It is thus a very important requirement that the height and the angular position of each of the strips can be adjusted precisely and in a simple manner, and that such adjustments can be changed easily.

An apparatus with which the angular positions of the strips can be adjusted at any time is known from the European patent publication EP-A2 539 027. That prior art apparatus has a guide rail fixed to the machine frame; it extends transversely to the direction of motion of the screen belt, and a carriage is displaceable along it. The carriage forms the support for a squeegee strip disposed on its top. To enable adjustment of the angular position of this strip, the guide rail is embodied with a plurality of longitudinally extending grooves in its longitudinal direction, which grooves are engaged by bolts that protrude from the carriage or from the support for the strip. Since these guide grooves extend at an incline to the direction of motion of the carriage, and since the grooves provided on different sides are inclined differently, a displacement of the carriage relative to the guide rail changes its angular position, and as a result the angular position of the top of the strip facing the screen belt is changed as well.

However, the prior art apparatus is disadvantageous in the sense that the length of the strip must be equal to the width of the screen belt plus the length of the guide grooves. Taking into account the fact that such strips are manufactured from a high-quality ceramic material, this involves major expense. Moreover, protecting the various components from the intrusion of the stripped-off water presents difficulties in the prior art apparatus. Sealing strips have been provided for that purpose, but they are only partly effective.

Another device of this type is known from German published, non-prosecuted patent application DE 40 19 921 A1. The device is embodied with a strip associated with the screen belt, the strip being pivotally supported on one side and on the other having a wedge strip associated with it that is displaceable transversely to the screen belt. Displacement of the wedge strip enables adjustment of the angular position of the strip relative to the screen belt, without having to displace the strip itself.

However, that prior art device does not quite meet the requirements, because the strip can be adjusted only in its angular position, while conversely its adjustment in height is not possible.

SUMMARY OF THE INVENTION

It is accordingly an object of the invention to provide an apparatus for adjusting the height and/or the angular position of a strip associated with the screen belt of a paper producing system, which overcomes the hereinafore-mentioned disadvantages of the heretofore-known devices of this general type and which makes it possible to adjust the strip as a function of the embodiment of the carriage and a support for the strip associated with the carriage, both in its angular position and in its height, relative to the screen belt.

With the foregoing and other objects in view there is provided, in accordance with the invention, a combination of a strip associated with a screen belt of a paper producing system, which strip extends transversely to a direction of motion of the screen belt, and an apparatus for adjusting a position of the strip. According to the invention, the adjusting apparatus comprises:

- a fixed guide rail fixedly attached to a machine frame of the paper producing system, adjusting means in the form of a carriage mounted displaceably along the fixed guide rail along a given direction of motion for adjusting the height of the strip relative to the fixed guide rail;
- a longitudinally nondisplaceable support attached to the strip, the carriage being disposed between the guide rail and the nondisplaceable support;
- guide elements disposed in one of the carriage and support for adjusting a height of the support relative to the fixed guide rail; one of the support and the carriage having lateral grooves formed therein for receiving the guide elements;
- the grooves extending at an incline relative to the direction of motion of the carriage by an angle of substantially between 0.5° and 5°.

In other words, the invention provides for a carriage to be disposed between the guide rail and a nondisplaceable support for the strip. The support for the strip is embodied with grooves on both its side faces, into which grooves guide elements, in particular bearing balls, provided in the carriage protrude. The grooves are inclined relative to the direction of motion of the carriage (i.e. the longitudinal axis of the frame-fixed guide rail) by an angle of between 0.5° and 5°. Alternatively, the grooves of suitable incline are provided in the carriage. In this case, the guide elements, such as bearing balls for instance, are provided in the support. The resultant effect is that the support is adjustable in its height and/or its angular position.

A major advantage of the afore-described invention is found in the fact that the strip need not be displaced relative to the screen belt. Accordingly, it suffices for its length to be equal to the width of the screen belt, which minimizes the expense in terms of material and production. Moreover, the components that are used to adjust the height or angular position of the strip can be provided with a cover, so that effective and complete protection against the intrusion of water can be attained.

In accordance with another feature of the invention, the carriage is supported in the guide rail by means of balls or rollers. For that purpose, the carriage may be embodied with longitudinally extending grooves in its side walls, into which grooves balls supported in the guide rail protrude. The balls may be retained in the guide rail by means of balls tensing screws.

In accordance with again a further feature of the invention, the carriage is displaceable by means of an adjusting spindle, and a measuring scale is provided in association with the spindle drive from which the height or angular position of the strip can be read.

In accordance with again an added feature of the invention, the angle of inclination of the particular groove that is located on the side toward the front edge of the strip is smaller than the angle of inclination of the particular groove that is located on the side remote from the front edge. As a result, the angular position of the strip is adjusted by way of moving the carriage.

In accordance with yet another feature of the invention, the support for the strip is embodied in two parts, and between the two parts, which are rigidly joined to one another, there is a sheath of an elastic material, such as rubber or plastic. The sheath encases the guide rail, the carriage, and a first part of the support. As a result, completely effective protection against the intrusion of water is achieved.

In accordance with a concomitant feature of the invention, the strip is detachably secured to the support. For that purpose, the strip may be embodied with a groove which can be slipped onto the second part, of T-shaped cross section, of the support. Moreover, the carriage is preferably embodied with longitudinally extending recesses, which are pierced by bolts anchored in the guide rail, and the free ends of the bolts protrude into recesses, which are disposed in the support for the strip. As a result, the support is nondisplaceably retained in the longitudinal direction. It is still possible, however, to adjust its height and its angular position.

Other features which are considered as characteristic for the invention are set forth in the appended claims.

Although the invention is illustrated and described herein as embodied in an apparatus for adjusting the height and/or the angular position of a strip associated with the screen belt of a paper producing system, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 2:
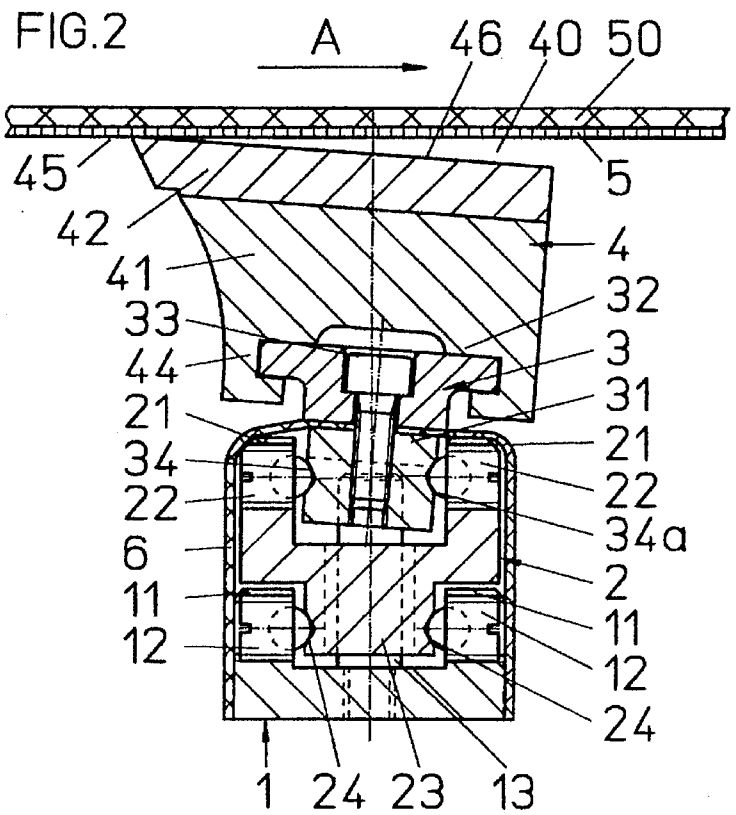
FIG. 2 is a section similar to that of FIG. 1, showing the device with an altered angular position of the strip, the section taken along the line II—II of FIG. 3.
Figure 1:
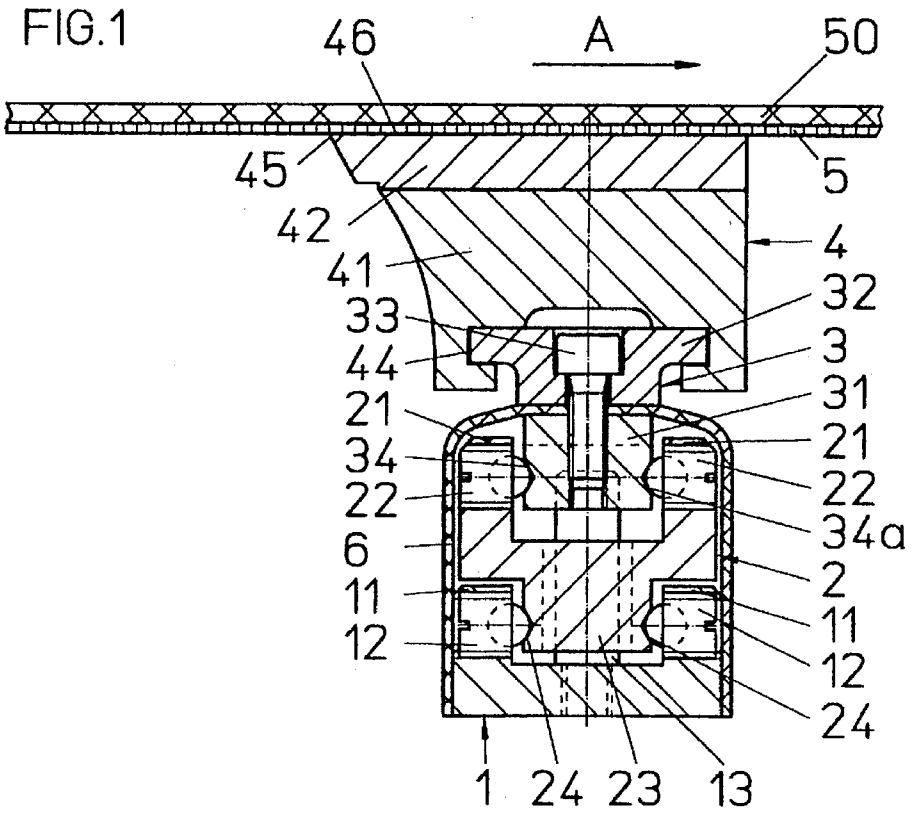
FIG. 1 is a cross-section of an apparatus according to the invention.

Referring now in detail to the figures of the drawing, and first, particularly, to FIGS. 1 and 2 thereof, an apparatus according to the invention comprises a guide rail 1 of essentially U-shaped cross-section which is fixed to a machine frame. Ball clamping or ball tensing screws 12 protrude inwardly from their location in the lateral upward-pointing arms 11 of the guide rail 1. A carriage 2 is guided in the guide rail 1. The carriage 2 is embodied with a centrally extending strip 23, that protrudes between the two arms 11 of the guide rail 1 and is likewise embodied with two lateral upwardly-pointing arms 21. Inwardly-projecting ball tensing screws 22 are disposed in the arms 21.

The central strip 23 has grooves 24 formed therein on both side walls, and the balls of the ball bearing screws 12 protrude into the grooves 24. As a result, the carriage 2 is guided in the rail 1.

Figure 4:
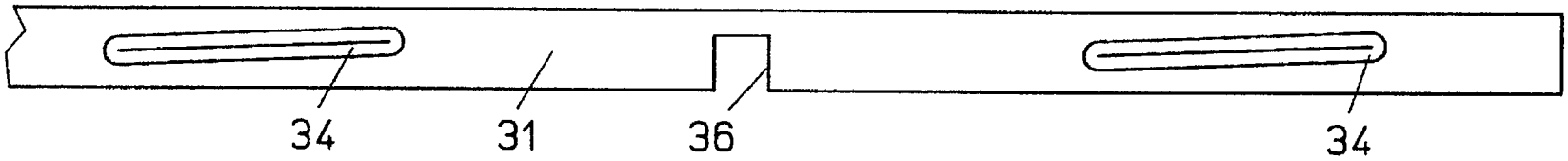
FIG. 4 is a partial, side-elevational view of a detail of the apparatus.

A support 3 for a strip 4 is associated with the carriage 2. The strip 4 is located below the screen belt 5 or the endless screen 5 of a paper producing system, and the position and angular alignment thereof must be accurately adjusted. The support 3 comprises a first part 31, which is located between the two arms 21 of the carriage 2. As seen in FIG. 4, the two side walls of the first part 31 are equipped with several sets of grooves 34 and 34*a*, into which the balls of the ball tensing screws 22 protrude. The support 3 also comprises a second part 32, which is rigidly joined to the first part 31 by screws 33. The second part 32 is T-shaped in cross section, and as a result the strip 4, embodied with a diametrically opposed recessed groove 44, can be slipped onto the second part 32.

The strip 4 comprises a first part 41, which is produced of glass fiber reinforced plastic, and a second part 42 secured on the first part 41 by means of form-locking clamps. The second part 42 is made of high-grade ceramic material and it represents the actual strip that is associated with the screen belt 5.

The guide rail 1, the carriage 2 and the first part 31 of the support 3 are encased with a sheath 6 of elastic material (e.g. rubber, plastic), which extends between the two parts 31 and 32. In addition, bolts 13 are screwed into the guide rail 1, which pass through longitudinally extending openings 26 or oblong holes 26 provided in the carriage 2. The bolts 13 further project into slitlike recesses 36 on the underside of the support. The recesses 36 extend transversely to the direction of motion of the carriage 2 and they are open at the bottom and are formed in the first part of the support 3.

The grooves 34, 34*a* provided in the first part 31 of the support 3 form an angle of approximately 3° (between 0.5° and 5°) relative to the direction of motion of the carriage 2 (the longitudinal axis of the fixed guide rail 1).

Figure 3:
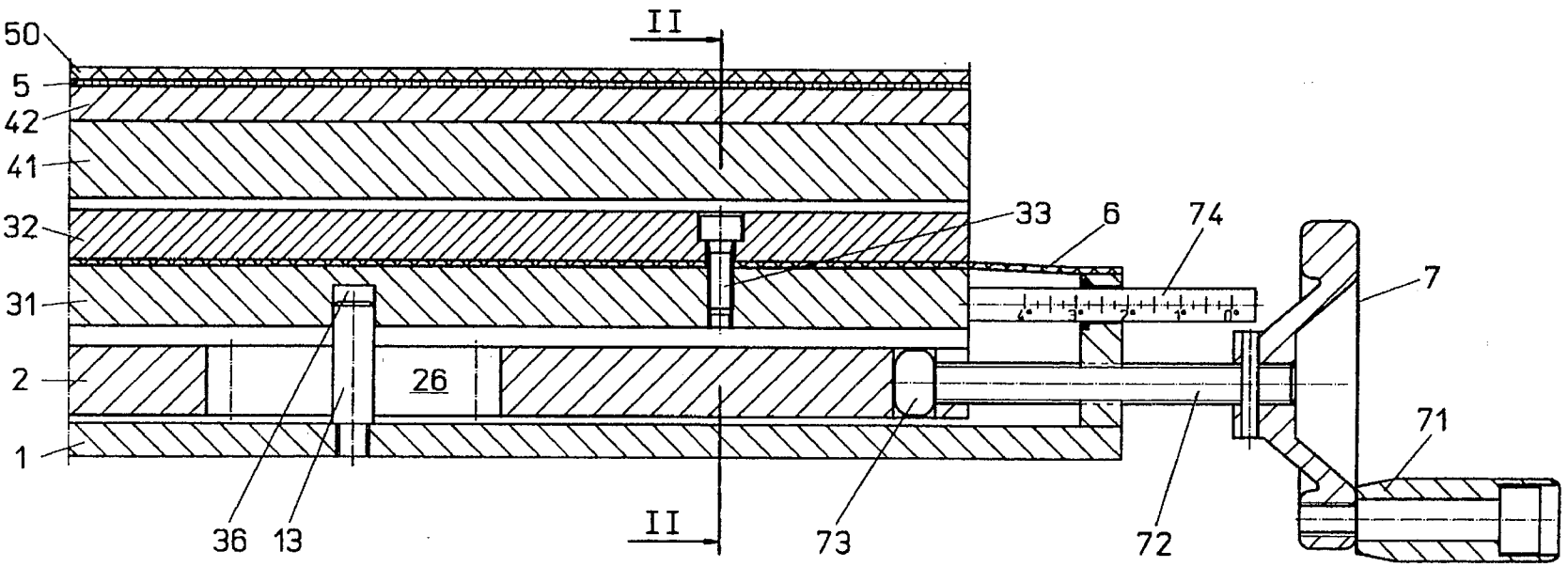
FIG. 3 is a longitudinal section through the apparatus on a slightly reduced scale as compared to FIGS. 1 and 2.

With reference to FIG. 3, an actuator 7 is associated with the guide rail 1; it comprises a hand crank 71 and an adjusting spindle 72 supported in threaded fashion in the guide rail 1. The carriage 2 is coupled in a slaved relationship to the free end of the adjusting spindle 72 by means of a disk 73. The actuator 7 is also embodied with a measuring scale 74.

In a first embodiment shown in FIG. 4, the grooves 34 and 34*a*, which are provided on the two side walls, respectively, of the first part 31, have the same angle of incline. When the carriage 2 is adjusted by the actuator 7, the balls of the ball tensing screw 12 roll along the grooves 24. The balls of the ball tensing screws 22 also roll along the grooves 34 and 34*a*. The result is an adjustment in height of the support 3 and hence also an adjustment in height of the strip 4 relative to the screen belt 5. Displacement of the support 3 is prevented by means of the bolts 13 protruding into the recesses 36. However, since the grooves 34 and 34*a* are inclined by an angle of approximately 3° relative to the adjusting direction of the carriage 2, the result of this is a change in height of the support 3 and hence of the strip 4. The extent of the adjustment can be read from a measuring scale.

By means of this apparatus, the height of the strip 4 can thus be adjusted precisely, in a simple way.

Figure 4A:
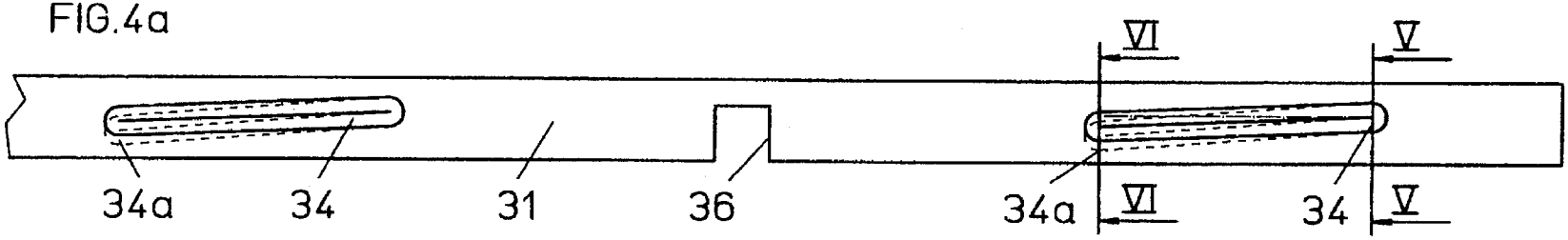
FIG. 4*a* is a similar view of an alternative embodiment thereof.
Figure 6:
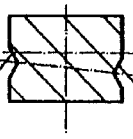
FIG. 6 is a cross-sectional view taken along the line VI—VI of FIG. 4*a*.
Figure 5:
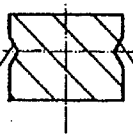
FIG. 5 is a cross-sectional view taken along the line V—V of FIG. 4*a;*

With reference to FIGS. 4*a*, 5 and 6, the grooves 34 and 34*a* in a second embodiment by comparison extend at different angles relative to the direction of motion of the carriage 2; the angle of the grooves 34 located closer to the front edge 45 of the strip 4 is smaller than the angle of the grooves 34*a* facing toward the rear edge thereof.

FIG. 1 shows the position of the strip 4 in which its top 46 rests flat on the underside of the screen 5. If the groove 34 and 34*a* have the same inclination, then a displacement of the carriage 2 brings about only an adjustment in height of the strip 4.

By comparison, FIG. 2 shows a pivoted position of the strip 4, which is brought about by a displacement of the carriage 2 if the grooves 34 and 34*a* are inclined differently from one another. As a result of this pivoted position, a wedge-shaped gap 40 is formed between the underside of the screen 5 and the top 46 of the strip 4. By means of this gap 40, as a consequence of the motion of the screen 5 in the direction of the arrow A, a negative pressure is generated, by which water is removed by suction from the pulp 50 located on the screen 5.

By suitable selection of the different angles of the grooves 34 and 34*a*, it is assured that when the strip 4 is pivoted, its front edge 45 is held at precisely the same height. This can be significant because if excessive wear of the strips 4 or additional loads on the screen 5 are to be averted, then the strips 4 must be positioned precisely in their positions. The bolts 13 which protrude into the recesses 36 located in the support 3 assure that the support 3 cannot longitudinally displaced. At the same time, however, the adjustability of the support 3 in order to adjust the height and/or the pivoted position is unhindered.

Instead of guiding the carriage 2 in the rail 1 by means of balls, a sliding guide may also be provided. In addition, the support 3 for the squeegee strips 4 (scraper blades 4) can be embodied with balls, which are guided in obliquely extending grooves that are provided in the carriage 2. In addition, a different mutual guidance between the carriage 2 and the support 3 may also be provided. The essential feature is that the support 3 for the strip 4 be nondisplaceable (in translational terms) but adjustable with regard to their height and angular position. As a result of the displacement of the carrier 2, which is guided in a rail 1 fixed to the machine frame, its height and/or pivoted position can be adjusted.

The drawing shows a system of this kind which has only a single screen belt 5, on whose top surface the pulp 50 is located, and on whose underside the strips that serve to produce an air stream or to scrape off the water passing through the screen are disposed. Apparatuses according to the invention may, however, also be provided in paper producing systems of the kind provided with two screen belts, between which the pulp is located, and the strips described are then disposed on the underside and optionally on the top of the two screens as well.

In addition, to reinforce the effects sought, suction boxes may be provided, for subjecting the pulp to vacuum pressures, i.e. to negative pressures relative to ambient pressure. The heights of the individual strips can also be chosen such that the at least one screen belt is guided along them in an undulating course.

Figure 7:
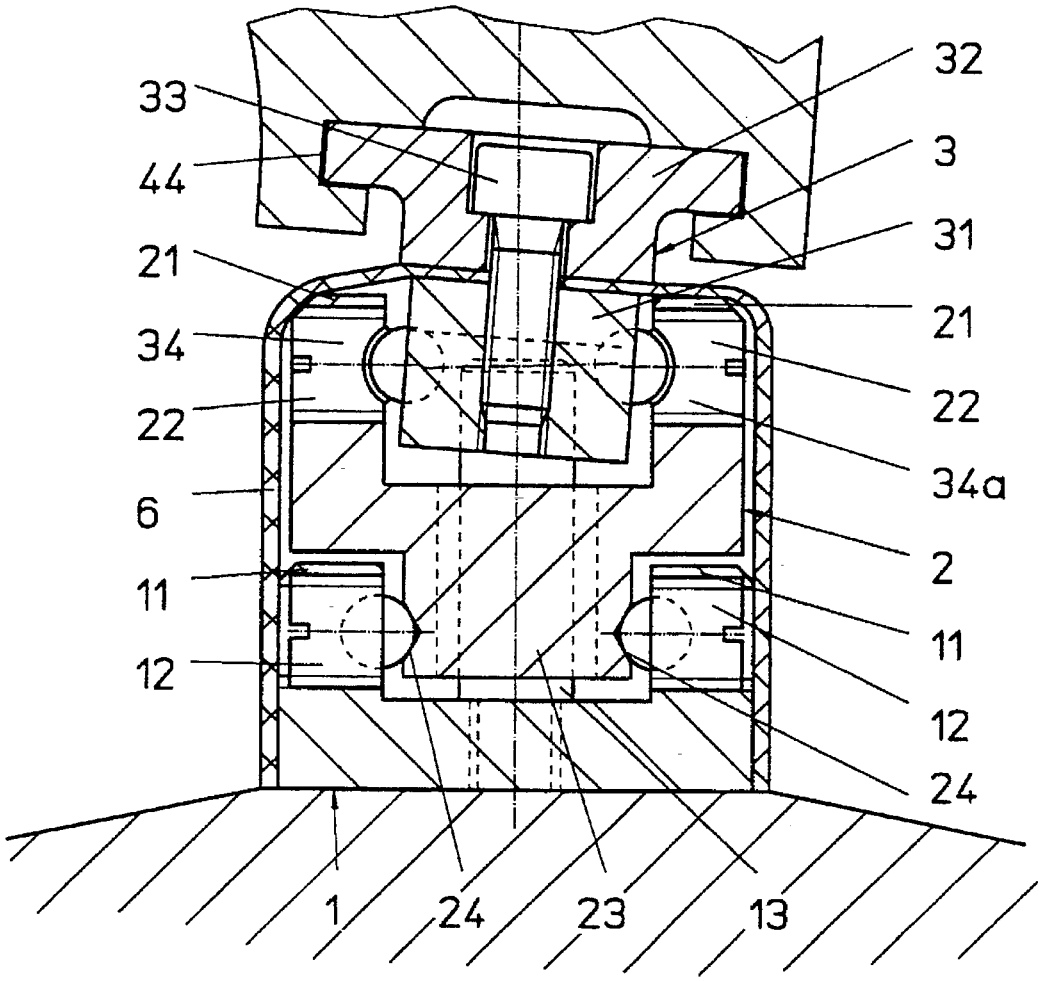
FIG. 7 is a partial view of the cross-section of FIG. 1 showing an alternative embodiment.

In the embodiment of FIG. 7, the balls of the ball bearing are alternatively placed in the support 3 and they roll in groove slots formed in the carrier 2.

We claim:

1. In combination with a strip associated with a screen belt in a paper producing system, the strip extending transversely to a direction of motion of the screen belt, having a length substantially equal to a width of the screen belt, and having a front edge and a rear edge, an apparatus for adjusting a position of the strip, said adjusting apparatus comprising:

a fixed guide rail fixedly attached to a machine frame of the paper producing system, adjusting means in the form of a carriage mounted displaceably along said fixed guide rail along a given direction of motion for adjusting the height of the strip relative to said fixed guide rail;

a longitudinally nondisplaceable support attached to the strip, said carriage being disposed between said guide rail and said nondisplaceable support;

guide elements disposed in one of said carriage and said support for adjusting a height of said support relative to said fixed guide rail;

the other one of said support and said carriage having lateral groove slots formed therein for receiving said guide elements;

said groove slots extending at an incline relative to the direction of motion of said carriage by an angle of substantially between 0.5° and 5°;

said groove slots including a first groove slot facing toward the front edge of the strip defining an angle of incline relative to the direction of motion of the carriage smaller than an angle of incline defined by a second groove slot facing toward the rear edge of the strip; and including further guide elements in the form of balls and rollers supporting said carriage in said guide rail.

2. The apparatus according to claim 1, wherein said groove slots are formed in said carriage, and said guide elements are balls carried in said support, said inclined groove slots being means for translating a relative sliding motion between said carriage and said support into a height or angular position adjusting motion of the strip.

3. The apparatus according to claim 1, wherein said groove slots are formed in said support, and said guide elements are balls carried in said carriage, said inclined groove slots being means for translating a relative sliding motion between said carriage and said support into one of height or angular position adjusting motion of the strip.

4. The apparatus according to claim 1, wherein said further guide elements are balls, and including ball tensing screws retaining said balls at said fixed guide rail.

5. The apparatus according to claim 1, including a spindle drive for displacing said carriage relative to said fixed guide rail, and a measuring scale associated with said spindle drive for indicating one of the height and the angular position of the strip.

6. The apparatus according to claim 1, wherein said groove slots are formed in said carriage.

7. The apparatus according to claim 1, wherein said groove slots are formed in said support.

8. The apparatus according to claim 1, wherein the strip is secured detachably on said support.

9. The apparatus according to claim 1, wherein said support comprises first and second parts rigidly connected to one another, said second part having a T-shaped cross section, the strip having a recessed groove formed therein receiving said second part such that the strip may be slipped onto said second part.

10. The apparatus according to claim 1, wherein said carriage has longitudinally extending openings formed therein, and including bolts protruding through said openings, said bolts being anchored in said guide rail, said bolts having free ends protruding into recesses formed in an underside of said support and extending transversely to the direction of motion to said carriage.

11. In combination with a strip associated with a screen belt in a paper producing system, the strip extending transversely to a direction of motion of the screen belt, an apparatus for adjusting a position of the strip, said adjusting apparatus comprising:

a fixed guide rail fixedly attached to a machine frame of the paper producing system, adjusting means in the form of a carriage mounted displaceably along said fixed guide rail along a given direction of motion for adjusting the height of the strip relative to said fixed guide rail;

a longitudinally nondisplaceable support attached to the strip, said carriage being disposed between said guide rail and said nondisplaceable support; guide elements disposed in one of said carriage and said support for adjusting a height of said support relative to said fixed guide rail;

the other one of said support and said carriage having lateral groove slots formed therein for receiving said guide elements;

said groove slots extending at an incline relative to the direction of motion of said carriage by an angle of substantially between 0.5° and 5°, wherein said support comprises first and second parts rigidly connected to one another, and including a sheath extending between said first and second parts, said sheath enclosing said guide rail, said carriage, and said first part.

12. The apparatus according to claim 11, wherein said sheath is formed of an elastic material selected from the group consisting of rubber and plastic.

* * * * *